US009739269B2

(12) United States Patent
Leifert et al.

(10) Patent No.: US 9,739,269 B2
(45) Date of Patent: Aug. 22, 2017

(54) SYSTEM, PUMP AND METHOD OF VACUUM GENERATION FOR APPLICATIONS TO MOTOR VEHICLES

(71) Applicant: VHIT S.P.A., Offanengo (IT)

(72) Inventors: Volker Leifert, Offanengo (IT); Leonardo Cadeddu, Offanengo (IT); Guido Zardo, Offanengo (IT)

(73) Assignee: VHIT S.P.A., Offanengo (CR) (IT)

( * ) Notice: Subject to any disclaimer, the term of this patent is extended or adjusted under 35 U.S.C. 154(b) by 393 days.

(21) Appl. No.: 14/362,941

(22) PCT Filed: Nov. 22, 2012

(86) PCT No.: PCT/IB2012/056628

§ 371 (c)(1),
(2) Date: Jun. 5, 2014

(87) PCT Pub. No.: WO2013/084100

PCT Pub. Date: Jun. 13, 2013

(65) Prior Publication Data

US 2015/0125311 A1 May 7, 2015

(30) Foreign Application Priority Data

Dec. 5, 2011 (IT) ..... TO2011A1112

(51) Int. Cl.
*F04B 17/00* (2006.01)
*F04B 17/03* (2006.01)
(Continued)

(52) U.S. Cl.
CPC ..... *F04B 17/03* (2013.01); *F04B 17/05* (2013.01); *F04B 19/04* (2013.01); *F04C 15/008* (2013.01);
(Continued)

(58) Field of Classification Search
CPC ..... F04B 17/03; F04B 17/05; F04B 39/02; F04B 39/0207; F04C 15/0088; F04C 29/021
See application file for complete search history.

(56) References Cited

U.S. PATENT DOCUMENTS 3,991,854 A * 11/1976 Tilley ..... F01M 11/045 184/1.5
4,491,094 A * 1/1985 Ogawa ..... B60K 25/00 123/41.49
(Continued)

FOREIGN PATENT DOCUMENTS

DE 10 2009 046 006 A1 4/2011
EP 1 108 892 A2 6/2001
(Continued)

*Primary Examiner* — Charles Freay
*Assistant Examiner* — Christopher Bobish
(74) *Attorney, Agent, or Firm* — Sughrue Mion, PLLC

(57) ABSTRACT

A vacuum generation system, in particular for applications to hybrid-drive motor vehicles, comprises a vacuum pump (10) arranged to be independently driven by either an internal combustion engine (1 1) or an electric motor (12) depending on the vacuum conditions in utilizing devices (15) and the operating conditions of the internal combustion engine. A pump for use in such a system and a method of vacuum generation by using the system are also provided.

18 Claims, 2 Drawing Sheets

(51) Int. Cl.

| | |
|---|---|
| ***F04C 23/02*** | (2006.01) |
| ***F04C 25/02*** | (2006.01) |
| ***F04C 29/00*** | (2006.01) |
| ***F04C 29/02*** | (2006.01) |
| ***F04B 17/05*** | (2006.01) |
| ***F04B 19/04*** | (2006.01) |
| *F04B 39/02* | (2006.01) |
| *F04C 15/00* | (2006.01) |
| *F04C 18/344* | (2006.01) |

(52) U.S. Cl.

CPC ..... *F04C 23/02* (2013.01); *F04C 25/02* (2013.01); *F04C 29/0071* (2013.01); *F04C 29/0085* (2013.01); *F04C 29/021* (2013.01); *F04B 39/02* (2013.01); *F04B 39/0207* (2013.01); *F04C 15/0088* (2013.01); *F04C 18/344* (2013.01)

(56) References Cited

U.S. PATENT DOCUMENTS

| | | | | |
|---|---|---|---|---|
| 8,267,072 | B2 * | 9/2012 | Pursifull ..... | B60T 17/02 123/198 C |
| 9,458,841 | B2 * | 10/2016 | Tazume ..... | F04B 17/03 |
| 2006/0091730 | A1 | 5/2006 | Chiao | |
| 2007/0284937 | A1 | 12/2007 | Deiml et al. | |
| 2010/0230187 | A1 | 9/2010 | Kraft et al. | |
| 2012/0253574 | A1 | 10/2012 | Krueger et al. | |

FOREIGN PATENT DOCUMENTS

| | | | |
|---|---|---|---|
| WO | 2010/130238 | A2 | 11/2010 |
| WO | 2010/145634 | A2 | 12/2010 |

* cited by examiner

SYSTEM, PUMP AND METHOD OF VACUUM GENERATION FOR APPLICATIONS TO MOTOR VEHICLES

CROSS REFERENCE TO RELATED APPLICATIONS

This application is a National Stage of International Application No. PCT/IB2012/056628, filed Nov. 22, 2012, claiming priority from Italian Patent Application No. TO2011A001112, filed Dec. 5, 2011, the contents of all of which are incorporated herein by reference in their entirety.

TECHNICAL FIELD

The present invention relates to vacuum pumps, and more particularly it concerns a system for vacuum generation for applications in the automotive field, a vacuum pump that can be used in such a system and a method of vacuum generation by using the system and the pump.

Preferably, the invention is intended for use in motor vehicles with hybrid drive, i.e. motor vehicles equipped with an internal combustion engine and an electric motor.

PRIOR ART

Several devices in a motor vehicle require a depression for operating. An example is the brake booster. In most present vehicles, depression is generated by a vacuum pump that, after depression has been generated, is operated to compensate vacuum consumption by the utilising devices and losses.

In hybrid-drive vehicles, it is customary to use two independent vacuum sources for such a purpose, namely a pump operated by the internal combustion engine ("mechanical pump") and a pump operated by the electric motor ("electric pump"). Such a solution allows generating vacuum also when the internal combustion engine is off, this entailing however a pump duplication and hence a cost increase. Moreover, the conventional mechanical pumps, if they are designed with such characteristics as to meet the requirements of air evacuation speed at low rotation speeds of the engine, will be overdimensioned at higher rotation speeds, and this entails higher power absorption and hence higher consumptions and higher environmental pollution. In turn, electric pumps are relatively expensive and difficult to be managed and, very often, they are dry-operating and hence have a lower reliability and a shorter duration.

US 2010/0230187 discloses a vacuum pump for a hybrid-drive vehicle, which pump is operated by the only electric motor which, in turn, may be driven by the internal combustion engine. The pump has a variable delivery rate and is associated with a vacuum-controlled driver that turns the pump off when the vacuum level in a vacuum accumulator is sufficient. In case of long periods of intermittent movement with electrically operating vehicle, an ancillary pump operated by an own electric motor is required.

It is an object of the present invention to provide a system for and a method of vacuum generation for automotive applications, and a pump to be used in such a system, which obviate the drawbacks of the prior art.

DESCRIPTION OF THE INVENTION

According to the invention, this is achieved by using a vacuum pump arranged to be connected to an internal combustion engine (hereinafter also referred to as "thermal engine") and to an electric motor, preferably dedicated to the pump, and to be independently driven by either the engine or the motor depending on the operating conditions of the thermal engine and the vacuum conditions in utilising devices.

When the thermal engine operates at low rotation speed, the pump may be driven by the electric motor at such a speed as to meet the vacuum requirements of the utilising devices. In this way, the pump displacement may be reduced, with a consequent reduction in power absorption while the pump is being driven by the internal combustion engine.

According to an advantageous feature of the invention, the electric motor is arranged to be driven by the pump and to operate as a generator when the pump is being driven by the internal combustion engine According to another advantageous feature of the invention, the system is connected to the lubricating circuit of the thermal engine so that the pump is lubricated in case of both mechanical drive by the thermal engine, and electric drive by the electric motor.

The invention also provides a vacuum pump, which is independently operable by an internal combustion engine or an electric motor, preferably dedicated to the pump, and which is associated with a lubricating circuit arranged to lubricate the pump with lubricant under pressure supplied by the thermal engine when the pump is being operated by said engine, and with lubricant sucked by the pump from the engine sump, when the pump is being driven by the electric motor.

In the alternative, the pump might be self-lubricating and suck oil from the oil sump only, independently of whether the pump is driven by the engine or the motor.

The invention also provides a method of generating vacuum, comprising the steps of:

- providing a vacuum pump arranged to be independently driven by a thermal engine or an electric motor;
- driving the pump by means of the thermal engine if the vacuum level in utilising devices is sufficient or the thermal engine is operating at a speed not lower than a minimum speed;
- driving the pump by means of the electric motor if the vacuum level is insufficient and the thermal engine is off or is operating at a speed lower than the minimum speed.

BRIEF DESCRIPTION OF THE FIGURES

Other features and advantages of the invention will become apparent from the following description of preferred embodiments, given by way of non limiting examples with reference to the accompanying drawings, in which.

DESCRIPTION OF PREFERRED EMBODIMENTS

Figure 1:
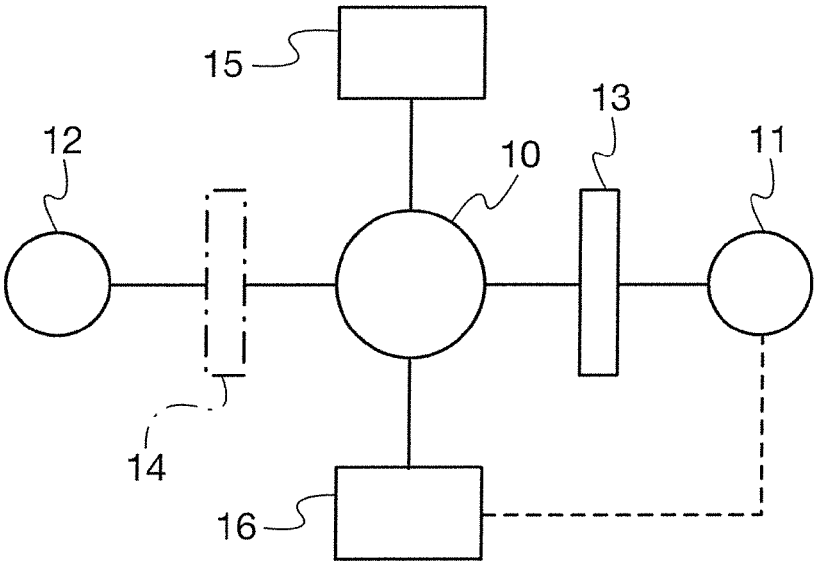
FIG. 1 is a basic diagram of a vacuum generation system according to the invention.
Figure 2:
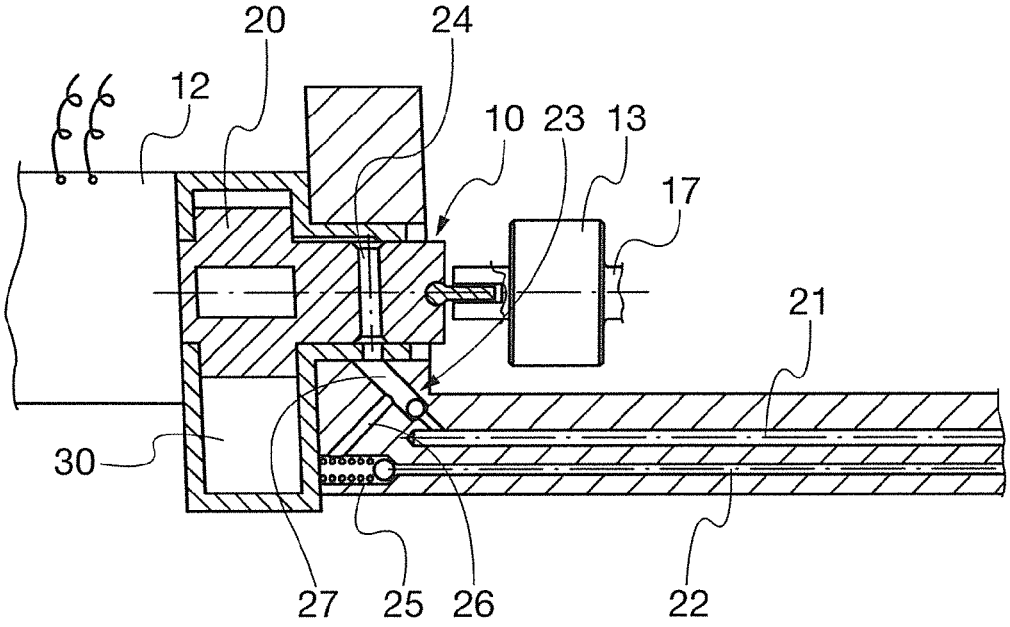
FIG. 2 is a cross-sectional view showing the pump used in the system shown in FIG. 1 together with part of its lubricating system.

Referring to FIGS. 1 and 2, according to the invention a vacuum pumping system 1 comprises a vacuum pump 10, which is independently operable by a thermal engine 11 or an electric motor 12, preferably dedicated to the pump, in order to create vacuum in utilising devices 15. In the preferred application of the invention, engine 11 belongs to a hybrid-drive vehicle. Electric motor 12 is to drive the pump when vacuum generation is required and thermal engine 11 is off or rotates at a speed insufficient for the pump to meet the requirements of utilising devices 15, whereas in the other conditions the pump is driven by thermal engine 11. Moreover, pump 10 is connected to lubricating circuit 16 of engine 11 so as to be lubricated in case of both mechanical and electric drive.

A first one-way coupling 13, for instance a freewheel coupling, is arranged between thermal engine 11 and the pump in order to disconnect pump 10 from engine 11 when the pump is operated by electric motor 12. A second freewheel one-way coupling 14, shown only in the diagram of FIG. 1, may be provided between electric motor 12 and pump 10 in order to disconnect electric motor 12 from pump 10 while thermal engine 11 is operating.

Pump 10 preferably is a rotary positive displacement pump, for instance a vane pump, mounted on the cam shaft or the drive shaft of engine 11—Thanks to the fact that at low rotation speeds of thermal engine 11, for instance in case of vehicle running in neutral gear or with slow-running engine, pump 10 can be driven by electric motor 12, pump 10 may have a reduced displacement if compared to the conventional mechanical vacuum pumps used for the same applications. For instance, pump 10 may have a displacement of about 50-60 $cm^3$, i.e., substantially ⅙ the displacement of the conventional pumps dimensioned so as to operate at low speed, typically 300-400 rpm, whereas electric motor 12 will operate at about 2,500 rpm, thereby ensuring the necessary air discharge capability notwithstanding the reduced displacement of pump 10.

The axis of rotor 20 of pump 10 may coincide with the axes of the driving shafts transmitting it the motion of thermal engine 11 or electric motor 12, as shown in FIG. 2. In the alternative, the pump axis may be parallel to at least one of said axes. It is also possible that the shaft of electric motor 12 is arranged perpendicularly to the axis of the pump rotor. Of course, if the axes do not coincide, suitable means transmitting the motion from the driving shafts to the rotor shaft have to be provided.

Electric motor 12 typically is a d.c. motor, for instance an electronically switched motor, and it can also be used as a generator when pump 10 is driven by thermal engine 11. When use as a generator is not desired, for instance in case of electric motors with brushes having a relatively short life, the second one-way coupling 14 mentioned above will be provided.

An important issue of the invention is the lubrication of pump 10.

Lubricating circuit 16 (of which FIG. 2 shows the portion conveying oil to pump 10), operates in two different ways, depending on whether the vehicle is driven by thermal engine 11 or electric motor 12. In the first case, the circuit operates like in the case of a conventional pump with mechanical drive, and pump 10 receives oil under pressure from thermal engine 11 through a first inlet duct 21 associated with a first one-way check valve (nonreturn valve) 23 opening at a pressure equal to or higher than a first threshold, for instance 0.3 bars. In the second case, pump 10 directly sucks oil from the oil sump through a second inlet duct 22, associated with a second nonreturn valve 25 opening at a pressure lower than or equal to a second threshold, lower than the first one, for instance 0.1 bars.

Valve 23 lets oil under pressure pass to a duct or hole 24 formed in rotor 20 and communicating with chamber 30 of pump 10. The air-oil mixture becoming formed in chamber 30 is then discharged towards engine 11. For the sake of simplicity of the drawing, the discharge duct is not shown.

Valve 25 lets sucked oil pass towards a duct 26 ending into chamber 27 of valve 23 and hence towards duct 24. Oil contained in the air-oil mixture becoming formed in chamber 30 is then separated from air through the conventional engine oil separator (not shown) and sent back to lubrication circuit 16.

It is to be appreciated that, when valve 23 is open, nonreturn valve 25 prevents oil coming from inlet 21 from flowing to inlet 22 and, conversely, when valve 25 is open, nonreturn valve 23 prevents oil from flowing from duct 26 to inlet 21.

Thanks to the provision of second inlet duct 22, pump lubrication is possible also in case of a failure of electric motor 12 and at low rotation speeds of thermal engine 11. In the latter case, pump 10 will operate with a reduced delivery rate and hence a reduced vacuum level.

Figure 3:
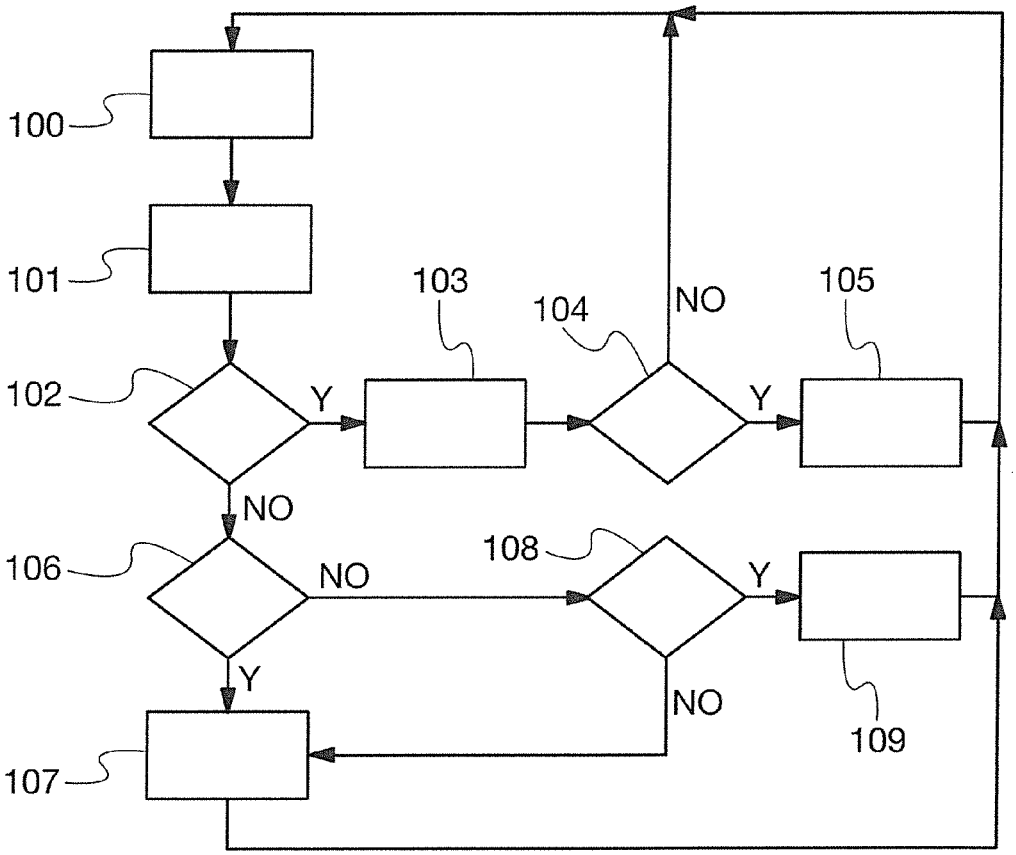
FIG. 3 is a flow chart of the method according to the invention.

FIG. 3 shows a flow chart of the method according to the invention.

Of course, the pump operates when the vehicle is in use (step 100). When vacuum is requested by the system operating under depression (step 101), the operation modalities of the pump depend on the outcome of a check on the vacuum level in the system operating under depression (step 102).

If the vacuum level is sufficient (output Y from step 102), the request is met (step 103). Moreover, if the vehicle is being braked (output Y from step 104), electric motor 12 can be used as a generator for energy recovery (step 105). The operation is then resumed from step 100, to which the process returns also if the vehicle is not being braked (output NO from step 104).

If the vacuum level is insufficient (output NO from step 102), the subsequent steps depend on the state of thermal engine 11. If the latter is off (output Y from step 106), the pump is driven by electric motor 12 (step 107). If thermal engine 11 is on (output NO from step 106), a check is further made (step 108) on whether the engine is operating at a speed exceeding a given minimum speed, for instance 1,500 rpm. In the affirmative (output Y from step 108), the pump is driven by the thermal engine (step 109), whereas in the negative (output NO from step 108), the process returns to step 107. The process then returns from steps 107 and 109 to step 100.

The invention actually solves the problems of the prior art. The structure is simpler and less expensive, since there is a single pump driven by either the engine or the motor depending on the vacuum level in the utilising devices and the operating conditions of the thermal engine. Moreover, a pump with a much smaller displacement than the conventional pumps can be used, thereby reducing power absorption and hence consumptions during mechanically driven operation.

It is to be appreciated that in steady state condition (steps 100 to 105), the operation of pump 10 would not be necessary. However, as stated above, taking into account the reduced displacement, the power absorption during mechanical drive is very small and thus it is not necessary to use pumps that can be disconnected from the engine during the periods in which pump operation is not required, which pumps are much more complex and therefore expensive.

It is clear that the above description has been given only by way of non limiting example and that changes and modifications are possible without departing from the scope of the invention. Thus, for instance, even if reference has been made to a vacuum generation system for a hybrid-drive vehicle, the invention can of course be used also in conventional vehicles equipped with the internal combustion engine only.

Moreover, even if a pumping system has been disclosed where lubrication can use either oil under pressure supplied by the thermal engine, or oil directly sucked from the oil sump, the pump could be self-lubricating and suck oil from the sump under any operating condition. In such case, duct 21, valve 23 and preferably valve 25 will be dispensed with.

The invention claimed is:

1. A vacuum generation system, comprising a vacuum pump and an electric motor arranged to drive the pump, wherein the vacuum pump is arranged to be connected also to an internal combustion engine of a motor vehicle and to be independently driven by either the engine or the motor depending on vacuum conditions in utilising devices and on operating conditions of the internal combustion engine, wherein the system is equipped with a lubricating circuit for the pump including:

a first inlet port arranged to receive lubricant under pressure from the internal combustion engine and associated with a first check valve arranged to let the lubricant under pressure from the internal combustion engine pass towards the pump when the lubricant under pressure from the internal combustion engine has a pressure at least equal to a first predetermined value; and a second inlet port arranged to receive lubricant sucked from a reservoir and associated with a second check valve arranged to let the lubricant sucked from the reservoir pass towards the pump when the lubricant sucked from the reservoir has a pressure which does not exceed a second predetermined value, lower than the first predetermined value.

2. The system as claimed in claim 1, wherein the internal combustion engine is an engine of a hybrid-drive motor vehicle and the electric motor is a motor dedicated to the pump.

3. The system as claimed in claim 1, wherein a first one-way coupling, arranged to disconnect the pump from the internal combustion engine when the pump is being driven by the electric motor, is provided between the internal combustion engine and the pump.

4. The system as claimed in claim 2, wherein a first one-way coupling, arranged to disconnect the pump from the internal combustion engine when the pump is being driven by the electric motor, is provided between the internal combustion engine and the pump.

5. The system as claimed in claim 1, wherein the electric motor is arranged to be operated by the pump as a generator when the pump is being driven by the internal combustion engine.

6. The system as claimed in claim 2, wherein the electric motor is arranged to be operated by the pump as a generator when the pump is being driven by the internal combustion engine.

7. The system as claimed in claim 3, wherein the electric motor is arranged to be operated by the pump as a generator when the pump is being driven by the internal combustion engine.

8. The system as claimed claim 4, wherein the electric motor is arranged to be operated by the pump as a generator when the pump is being driven by the internal combustion engine.

9. The system as claimed in claim 1, wherein a second one-way coupling, arranged to disconnect the pump from the electric motor when the pump is being driven by the internal combustion engine, is provided between the electric motor and the pump.

10. The system as claimed in claim 2, wherein a second one-way coupling, arranged to disconnect the pump from the electric motor when the pump is being driven by the internal combustion engine, is provided between the electric motor and the pump.

11. The system as claimed in claim 3, wherein a second one-way coupling, arranged to disconnect the pump from the electric motor when the pump is being driven by the internal combustion engine, is provided between the electric motor and the pump.

12. The system as claimed in claim 4, wherein a second one-way coupling, arranged to disconnect the pump from the electric motor when the pump is being driven by the internal combustion engine, is provided between the electric motor and the pump.

13. The system as claimed in claim 1, wherein the system is configured to be used in a motor vehicle.

14. A vacuum pump, wherein the vacuum pump is independently operable by an internal combustion engine or an electric motor and has a lubricating system including:

a first inlet port for receiving lubricant under pressure supplied by the internal combustion engine;

a first check valve associated with the first inlet port and arranged to let the lubricant under pressure supplied by the internal combustion engine pass towards the pump when the lubricant under pressure supplied by the internal combustion engine has a pressure at least equal to a first predetermined value;

a second inlet port for receiving lubricant sucked by the pump from a reservoir; and a second check valve associated with the second inlet port for the lubricant sucked by the pump from the reservoir and arranged to let the lubricant sucked by the pump from the reservoir pass towards the pump when the lubricant pressure has a pressure which does not exceed a second predetermined value, lower than the first predetermined value.

15. The pump as claimed in claim 14, wherein the electric motor is a motor dedicated to the pump.

16. The pump as claimed in claim 14, wherein the pump is configured to be used in a motor vehicle.

17. A method of generating vacuum in devices in a motor vehicle, wherein the generating the vacuum comprises the steps of:

providing a vacuum pump arranged to be independently driven by an internal combustion engine or an electric motor and comprising a first lubricant inlet port associated with a first check valve and a second lubricant inlet port associated with a second check valve;

checking a vacuum level in utilising devices and operating conditions of the internal combustion engine;

driving the pump by means of the internal combustion engine if the vacuum level is sufficient or the internal combustion engine is operating at a speed not lower than a minimum speed;

driving the pump by means of the electric motor if the vacuum level is insufficient and the internal combustion engine is off or is operating at a speed lower than the minimum speed;

lubricating the pump:

with lubricant under pressure supplied by the internal combustion engine and delivered to the pump through the first check valve and the first lubricant inlet port, when the pump is being driven by the internal combustion engine, wherein the first check valve is arranged to let the lubricant under pressure supplied by the internal combustion engine pass towards the pump when the lubricant under pressure has a pressure at least equal to a first predetermined value, and with lubricant sucked by the pump from a reservoir and delivered to the pump through the second check valve and the second lubricant inlet port, when the pump is being driven by the electric motor, wherein said second check valve is arranged to let the lubricant sucked from the reservoir pass towards the pump when the lubricant sucked from the reservoir has a pressure which does not exceed a second predetermined value, lower than the first predetermined value.

18. The method as claimed in claim 17, comprising the step of operating the electric motor as a generator when the vehicle is braking and the pump is being driven by the internal combustion engine.

* * * * *